United States Patent [19]

Dries

[11] Patent Number: 4,531,570

[45] Date of Patent: Jul. 30, 1985

[54] METHOD AND APPARATUS FOR CONTINUOUSLY CLEANING A HEAT EXCHANGER DURING OPERATION

[75] Inventor: Hubertus W. A. A. Dries, Amsterdam, Netherlands

[73] Assignee: Shell Oil Company, Houston, Tex.

[21] Appl. No.: 551,744

[22] Filed: Nov. 14, 1983

[30] Foreign Application Priority Data

Nov. 26, 1982 [NL] Netherlands ..... 8204603

[51] Int. Cl.[3] ..... F28G 13/00

[52] U.S. Cl. ..... 165/1; 165/95; 165/104.16; 165/104.18; 209/144

[58] Field of Search ..... 165/95, 1, 104.16, 104.18; 422/146, 139, 143, 145; 209/144

[56] References Cited

U.S. PATENT DOCUMENTS 3,952,022 4/1976 Becuwe ..... 165/104.16
4,419,965 12/1983 Garcia-Mallol et al. ..... 122/4 D
4,437,979 3/1984 Woebcke et al. ..... 165/104.16

FOREIGN PATENT DOCUMENTS 153363 12/1979 Japan ..... 165/104.16

*Primary Examiner*—Albert W. Davis, Jr.

[57] ABSTRACT

The walls of a heat exchanger for cooling a particle-contaminated gas are continuously cleaned by adding cleaning particles to the gas, separating the cleaning particles, and collecting the separated cleaning particles into a fluidized bed providing sufficient hydrostatic pressure to displace cleaning particles into the heat exchanger.

6 Claims, 2 Drawing Figures

METHOD AND APPARATUS FOR CONTINUOUSLY CLEANING A HEAT EXCHANGER DURING OPERATION

BACKGROUND OF THE INVENTION

The invention relates to a method for continuously cleaning a heat exchanger during operation as well as to an apparatus to be used with such a method.

More specifically, the invention relates to a method for continuously cleaning a heat exchanger of a type called the closed loop type, which is provided with a series of heat exchanging pipes, with one medium—for instance the cooling medium—passing through the pipes and the other medium—for instance the medium to be cooled—being carried along the pipes. Heat exchangers of this type are used on a large scale in many branches of industry, for instance in the petroleum and coal industries for cooling the products obtained from hydrocrackers and gasifiers. A cooling medium often used is water or air. When air is used, the cooling medium is usually passed through the heat exchanging pipes while the air is blown along the pipes at a high velocity. In a heat exchanger in which water is used as the cooling medium the water is usually carried through the pipes while the medium to be cooled flows along the pipes.

The invention relates to a method and apparatus for continuously cleaning a heat exchanger used for cooling a gaseous medium which is polluted by solid particles. Such a gaseous medium to be cooled may be for instance product gas obtained from the partial combustion of liquid or solid hydrocarbons. Such product gases usually contain fairly large quantities of small to very small solid particles, such as soot and fly ash. Particularly when the solid particles are somewhat sticky there is a risk of these particles adhering to the walls of the heat exchanging pipes when, along with the gas to be cooled, they are carried through a heat exchanger. However, such a particle buildup on the pipe walls will soon lead to a decrease in the rate of heat transfer between gas to be cooled and cooling medium. When the heat transfer efficiency of the heat exchanger has fallen to a certain level, the heat exchanging pipes have to be cleaned in order to restore their efficiency.

In practice, a vast variety of methods and devices are used for cleaning the surfaces of heat exchanging pipes. A well known cleaning method comprises passing solid particles, for instance grains of sand and tiny steel balls, along or through the heat exchanging pipes. During their passage these solid particles strike against the pipe walls and thus remove deposits from the pipe walls. The solid cleaning particles can be introduced into the heat exchanger during operation, which obviates the need for shutting down the heat exchanger for a turn-out.

If in case of severely polluted gases a heat exchanger is to maintain a constant maximum heat transfer efficiency, the pipe walls must preferably be cleaned continuously. According to the known method the continuous cleaning of the pipe walls can be performed by moving a stream of solid particles together with the gases in continuous circulation through the heat exchanger. In case of a heat exchanger used for cooling gas which is polluted by solid particles, the solid cleaning particles are preferably passed through the heat exchanger together with the gas stream forcing the solid cleaning particles along. When the gas containing the cleaning particles has left the heat exchanger, it is passed through a separator in order to remove the cleaning particles together with the entrained solid impurities from the gas stream. The separated cleaning particles may subsequently be recirculated to the heat exchanger to perform another cleaning cycle. In the abovementioned known method of continuously cleaning heat exchangers the solid particles are circulated by means of mechanical pumping. Particularly the use of rigid cleaning particles, such as sand grains, leads to a great deal of wear in the circulating pump due to the scouring effect of the solid particles.

According to another known method for continuously cleaning vertical pipe walls of a heat exchanger, solid cleaning particles are provided inside or outside the heat exchanging pipes in such a manner that, during operation, a fluidized bed is created by an upward flow of the heat absorbing or the heat emitting medium. This method has the advantage over the aforementioned method that the particles remain in the heat exchanger permanently and that therefore the medium carried along those particles need not be subjected to further treatment for separating the medium from the cleaning particles. However, the latter method does have a number of disadvantages, for instance the possibility of the fluidized bed of cleaning particles becoming choked by impurities, instability of the bed in case of fluctuations of the medium passing through the bed during operation, as well as the limited possibility of working at reduced throughput rates, since a certain minimum velocity of the medium is required to prevent the fluidized bed from collapsing.

It is an object of the invention to provide an improved method of continuously cleaning a heat exchanger, which does not require the use of mechanical pumping devices that can easily be damaged, and by which the solid particles themselves are continuously cleaned, so that the cleaning particles in the heat exchanger will produce an optimum effect which will also be maintained with none of the drawbacks adhering to the last-named clearing method.

It is another object of the invention to provide an apparatus to be used with such an improved cleaning method.

SUMMARY OF THE INVENTION

According to the present invention the method for the continuous cleaning, during operation, of a heat exchanger with heat exchanging pipes used for treating a gas which is polluted by solid particles, comprises feeding solid cleaning particles into a polluted gas which is to be cooled, allowing the gas containing the cleaning particles to pass through the heat exchanger, separating the cleaning particles from the treated gas, collecting the separated cleaning particles in a virtually vertically disposed, oblong collector, passing a gas stream through the collector in an upward direction in order to create a fluidized bed of cleaning particles in a manner causing said bed to both remove impurities from the cleaning particles and build up a thrust for moving the cleaning particles towards the heat exchanger in order to allow the cleaning particles to be recirculated into the heat exchanger.

According to the invention the apparatus to be used in the aforementioned method for continuously cleaning a heat exchanger with heat exchanging pipes during operation comprises a virtually vertically disposed cyclone with a tangential inlet for gas and cleaning particles, which inlet communicates with an outlet of the heat exchanger, a gas outlet in the upper part of the cyclone and an outlet for cleaning particles in the lower part of the cyclone, a virtually vertically disposed, oblong collector with an inlet which connects to the cleaning particles outlet of the cyclone and an outlet which communicates with an inlet of the heat exchanger, means for feeding a gas into the lower part of the collector and an open tubular element for the discharge of gas from the collector to the gas outlet of the cyclone, which element is fitted virtually coaxially to the inlet of the collector and the cleaning particles outlet of the cyclone.

DESCRIPTION OF THE INVENTION

In the afore-described method and apparatus according to the invention for continuously cleaning a heat exchanger with heat exchanging pipes, it is with two objectives that gas is supplied to the cleaning particles after they have been separated from the gas that has passed through the heat exchanger, viz. the removal of impurities entrained with the cleaning particles and the creation of a pressure gradient by building up a fluidized bed in a manner which allows the cleaning particles to be formed from the lower part of the bed to the entrance of the heat exchanger without mechanical pumping means being needed for this transport. The proposed method and apparatus enable heat exchangers to be kept in operation over a long period and with maximum efficiency.

Figure 1:
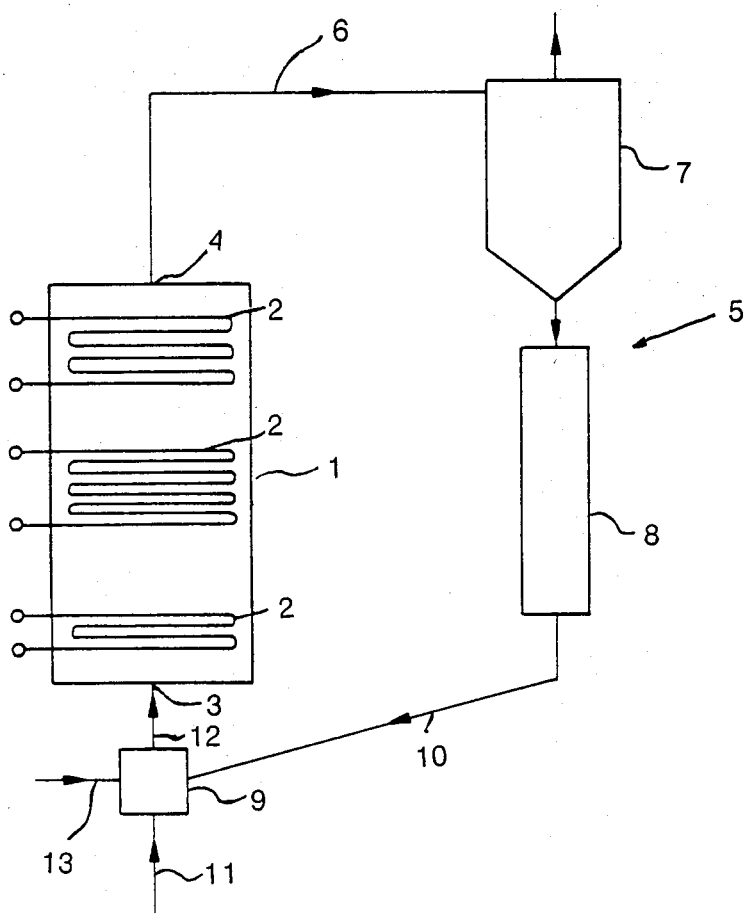
FIG. 1 shows a diagram of a system for continuously cleaning a heat exchanger according to the invention.

FIG. 1 gives a schematic representation of what is called a closed circulation system for the use and cleaning of heat exchangers. This system comprises a heat exchanger 1, which is used for instance for cooling product gases polluted by fine solid particles, such as fly ash or soot. Heat exchanger 1 is provided with a number of bundles of heat exchanging pipes 2 through which during operation for instance water, with or without steam, flows. The heat exchanger is provided with a gas inlet 3 and a gas outlet 4 which are connected with a circulation system—referred to as number 5—for solid cleaning particles which are passed through the heat exchanger together with the gas to be cooled.

The cleaning particles may be of a regular or an irregular shape and by preference they are hard. Suitable cleaning particles are, for instance, sand grains. While these particles pass through the heat exchanger together with the polluted gas to be cooled, they regularly collide with or scrape along the pipe walls. Thus, impurities which have been deposited on the walls are removed and carried along with the gas stream through the heat exchanger.

The cooled gas, together with the cleaning particles and the impurities contained therein, is subsequently fed through pipe 6, tangentially into a cyclone 7, where the cleaning particles are separated from the gas stream. Subsequently the gas stream is passed through a next cyclone not shown here in order to separate fine particles, such as fly ash, which have been left behind.

The separated cleaning particles are collected in a vessel 8, where they are brought into the fluidized state in a manner controlled to achieve a pressure build-up along the length of the vessel which is sufficiently large that the particles can be forced via the bottom of the vessel to mixing vessel 9 through a pipe 10. Moreover, in vessel 8 remaining impurities are removed from the cleaning particles, which will hereinafter be further discussed, with the aid of FIG. 2.

In mixing vessel 9 a monitored quantity of cleaning particles is continuously fed into a polluted gas stream to be cooled as the stream enters the mixing vessel through pipe 11. Then the gas and the cleaning particles are passed through pipe 12 to inlet 3 of the heat exchanger. Fresh cleaning particles can be fed to the gas to be cooled in mixing vessel 9, through pipe 13.

Figure 2:
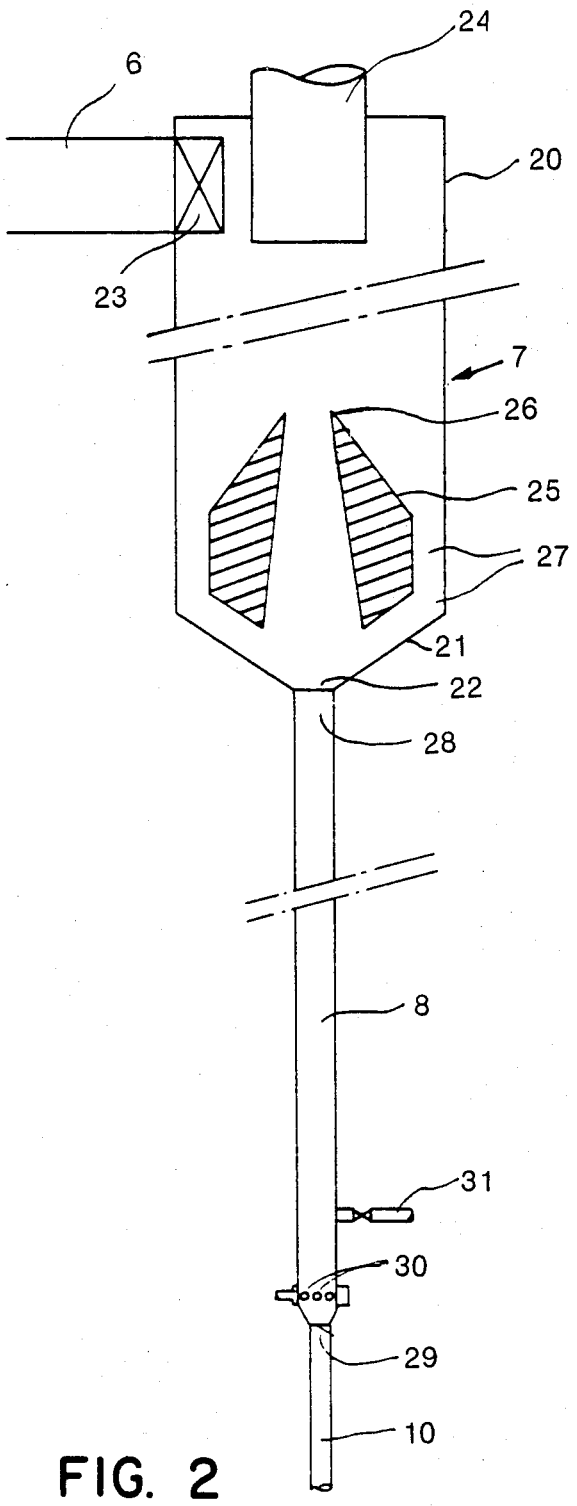
FIG. 2 shows a longitudinal section of an apparatus for use in this cleaning system.

Cyclone separator 7 and vessel 8, which constitute the most important parts of the system for circulating the cleaning particles, will now be further discussed with the aid of FIG. 2.

Cyclone separator 7, which during operation is positioned virtually vertically, comprises a cylindrical part 20 and a conical lower part 21, the open bottom of which constitutes the opening of the outlet 22 for cleaning particles. A tangential gas inlet 23 is fitted into the side wall of the cylindrical part 20. The cyclone is further provided with an open gas outlet pipe 24, the bottom end of which is situated below gas inlet 23. This gas outlet pipe 24 is fitted virtually coaxially with the cylindrical part 20.

In the lower part of cyclone 7 an open tubular element 25 is supported (on brackets not shown). The outer and inner walls of element 25 are virtually concentric with the cyclone wall and gas outlet 24. The opening through element 25 narrows slightly to the top and its walls are so shaped that the top 26 of element 25 forms a sharp edge. This sharp edge serves to enhance the stability of the cyclone, since the vortex of gas flowing to the outlet, which is created during operation, can adhere as it were to this edge.

The outer surface of the lower part of element 25 runs virtually concentrically with the inner surface of the conical part 21, so that an annular passage 27 is formed for the discharge of cleaning particles separated in the upper part of the cyclone. Immediately below the discharge opening 22 and virtually concentrically therewith, is arranged vessel 8, which in the drawn example is virtually tubular, with an open top end 28 and an open bottom end 29. Near the bottom end the wall of the vessel 8 is provided with a number of openings 30 for the admission of fluidization gas. Solid particles can be removed from the circulation system by way of a discharge pipe 31 which is fitted in the wall of the vessel. The bottom of the vessel 8 communicates with mixing vessel 9 via pipe 10, the lower part of vessel 8 being conical in order to create a smooth through-flow of cleaning particles into pipe 10, free from the risk of blocking-up.

During operation of heat exchanger 1 the cleaning particles, separated from the gas, leave cyclone 7 via the annular area 27 between the cyclone wall and element 25. Upon arriving in vessel 8 the particles are brought into the fluidized state by the injection of gas into vessel 8 through gas inlet openings 30. The rate of the gas injection is controllable to provide a hydrostatic pressure within the column of particles and compensate for the loss of pressure in heat exchanger 1 and cyclone 7 and to raise the overall pressure to such a level that, upon opening of a valve (not shown) situated in pipe 10, the cleaning particles are forced toward mixing vessel 9 and from there flow into heat exchanger 1 together with gas to be cooled.

The minimum length of the pressure recovery vessel 8 is determined by the pressure to be maintained in vessel 8 with the aid of a fluidized bed. A bed depth of 8 m of fluidized sand having for instance a density of 1000 kg/m$^3$ can lead to a pressure build-up of 0.8 bar. The gas injection into vessel 8 is primarily intended for pressure recovery and has an additional function to perform, i.e., that of cleaner. Solid impurities which have been carried along with the cleaning particles from cyclone 7, will be loosened by the upward flowing gas and carried off therewith. The gas enters the cyclone via the cleaning particles outlet 22 and then flows through the conduit in element 25 to the cyclone outlet 24 where, together with the gas separated in the cyclone, it will leave the cyclone. The cleaning particles which leave the cyclone through the annular passage 27 seal this passage off to the entering gas. A backpressure within the cyclone 7 and thus within the heat exchanger 1 is maintained by the next cyclone or other device (not shown) connected to the outlet of cyclone 7.

It is noted here that for the creation of the fluidized bed in vessel 8, for instance part of the gas separated in cyclone 7 can be used.

During the process of gas cooling the cleaning particles themselves will become somewhat polluted, for instance by sticky impurities from the gas adhering to them. It is therefore advisable to draw off part of the cleaning particles continuously or intermittently while simultaneously adding fresh cleaning particles. It is noted that, if required, further pressure can be added within the closed circulation system by injecting gas into pipe 10 which is situated between the pressure recovery vessel 8 and the mixing vessel. The quantity of cleaning particles needed may be controlled, for instance, by measuring the temperature prevailing in the gas reaching the end of the heat exchanger and adding cleaning particles as needed to maintain the desired extent of cooling. The thrust in pipe 10 can be used to adjust the supply of cleaning particles to the heat exchanger.

FIG. 1 represents a circulation system in which the gas, together with the cleaning particles, is carried through the heat exchanger in an upward direction. However, it is also posdible to arrange the circulation system in such a manner that the gas is forced to flow through the heat exchanger in a downward direction. In the system shown the mixing vessel 9 may, for instance, be constituted by what is called a "lift pot", in which the gas to be cooled is introduced at a lower level than the cleaning particles, so that said particles are carried along by the upward gas stream to the heat exchanger. In the above-mentioned alternative system the mixing vessel 9 is constituted for instance by a collector having a gas outlet in the bottom.

Finally, it is remarked that the cleaning procedure may be started up using, for instance sand as the cleaning particles, which sand may in the course of the procedure gradually be replaced by larger impurities from the gas stream which are separated from the gas stream together with the sand.

What is claimed is:

1. A method for continuously cleaning a heat exchanger while it is cooling gas which is polluted by solid particles, comprising:

feeding solid cleaning particles into the polluted gas being cooled;

passing the gas containing the cleaning particles through the heat exchanger;

separating the cleaning particles from the treated gas in a vertically disposed cyclone having a central portion which is located below the gas outlet of the cyclone and comprises a tubular element which is virtually centrally arranged in the lower part of the cyclone;

collecting the separated cleaning particles in a virtually vertically disposed, oblong collector which is situated under the cyclone, is virtually aligned with the tubular element in the cyclone and is in open communication with the cyclone; and passing a gas stream upward through the cleaning particles in the collector and the tubular element in the cyclone in a manner sufficient to create a fluidized bed of cleaning particles which removes impurities from the cleaning particles and builds up a thrust, due to the hydrostatic head of the bed of cleaning particles, for thrusting cleaning particles toward the heat exchanger and thus causing cleaning particles to be recirculated into the heat exchanger without the aid of mechanical pumping devices.

2. An apparatus for continuously cleaning a heat exchanger comprising:

a virtually vertically disposed cyclone having a tangential inlet for gas and cleaning particles, which inlet communicates with an outlet of the heat exchanger;

an outlet for gas in the upper part of the cyclone and an outlet for cleaning particles in the lower part of the cyclone;

a virtually vertically disposed, oblong collector having an inlet for cleaning particles which communicates with the outlet for cleaning particles of the cyclone and an outlet for cleaning particles which communicates with an inlet of the heat exchanger;

means for feeding gas into the lower part of the collector; and an open tubular element within the cyclone for discharging gas from the collector to the gas outlet of the cyclone, which tubular element has an outer surface which runs virtually concentrically with a downward sloping conical inner surface of a lower part of the cyclone, thus forming a downward sloping annular passageway for feeding particles into said outlet for cleaning particles and is arranged virtually coaxially with the inlet of the collector and the cleaning particles outlet of the cyclone so that gas fed into the lower part of the collector rises through cleaning particles in the collector and lower part of the cyclone and can create a fluidized bed of cleaning particles from which impurities are being removed and entrained in the gas discharged through the tubular element in the cyclone while developing a hydrostatic head sufficient for thrusting cleaned cleaning particles toward the heat exchanger without the aid of a mechanical pumping means.

3. The apparatus of claim 2 in which the open tubular element is provided with a bevelled upper edge.

4. The apparatus of claim 3 in which the open tubular element is provided with an outer surface which is at least partly coaxial with the inner surface of the cyclone.

5. The apparatus of claim 2 in which the collector is virtually tubular.

6. The apparatus of claim 2 in which the collector is provided with a number of supply openings for gas which are uniformly distributed over the circumference of a near bottom portion of the collector.

* * * * *